US006793010B1

(12) United States Patent
Manole

(10) Patent No.: US 6,793,010 B1
(45) Date of Patent: Sep. 21, 2004

(54) HEAT EXCHANGER HAVING NON-PERPENDICULARLY ALIGNED HEAT TRANSFER ELEMENTS

(75) Inventor: Dan M. Manole, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/456,449

(22) Filed: Jun. 6, 2003

(51) Int. Cl.[7] ..... F28F 13/12

(52) U.S. Cl. ..... 165/122; 165/150; 62/526; 62/515; 454/256

(58) Field of Search ..... 165/122, 121, 165/150, 151, 152, 124; 62/515, 526; 454/256

(56) References Cited

U.S. PATENT DOCUMENTS

| | | | | |
|---|---|---|---|---|
| 709,875 A | | 9/1902 | Commichau | |
| 1,663,301 A | | 3/1928 | Hart et al. | |
| 1,790,473 A | | 1/1931 | Hart et al. | |
| 1,924,998 A | | 8/1933 | McGrail | 257/151 |
| 1,942,432 A | | 1/1934 | Kimball et al. | 257/136 |
| 1,946,227 A | | 2/1934 | McGrail | 257/154 |
| 1,969,985 A | | 8/1934 | McGrail | 257/154 |
| 2,072,652 A | | 3/1937 | Shafner | 257/255 |
| 3,516,486 A | * | 6/1970 | Ledoux | 165/54 |
| 4,542,786 A | * | 9/1985 | Anders | 165/144 |
| 4,901,792 A | * | 2/1990 | Komiya | 165/150 |
| 5,505,257 A | * | 4/1996 | Goetz, Jr. | 165/183 |
| 5,850,872 A | * | 12/1998 | Cesaroni | 165/41 |
| 6,142,220 A | | 11/2000 | Motegi et al. | 165/135 |
| 6,227,001 B1 | | 5/2001 | Oyabu et al. | 62/262 |
| 6,253,839 B1 | * | 7/2001 | Reagen et al. | 165/151 |

FOREIGN PATENT DOCUMENTS

| | | | | |
|---|---|---|---|---|
| JP | 2000-97587 | * | 4/2000 | 165/151 |

* cited by examiner

*Primary Examiner*—Terrell McKinnon
(74) *Attorney, Agent, or Firm*—Baker & Daniels

(57) ABSTRACT

A heat exchanger having a fluid conveying conduit and a plurality of heat exchange elements thermally coupled with the conduit. The heat exchange elements have heat transfer surfaces that define at least one air flow passage through the heat exchanger that is non-perpendicularly aligned with the conduit. An air blower is operatively associated with the heat exchanger and generates airflow in a direction that is non-perpendicular to the heat exchanger conduit. The air flow direction generated by the blower and the air flow passage defined by the heat transfer surfaces through the heat exchanger may be substantially parallel or form an angle of no greater than approximately 30 degrees.

18 Claims, 3 Drawing Sheets

HEAT EXCHANGER HAVING NON-PERPENDICULARLY ALIGNED HEAT TRANSFER ELEMENTS

BACKGROUND OF THE INVENTION

1. Field of the Invention

The present invention relates to heal exchangers, and more specifically to heat exchangers used in a refrigeration or air conditioning system.

2. Description of the Related Art

A heat exchanger is a device used to transfer heat from a fluid on one side of a barrier to a fluid on the other side without bringing the fluids into direct contact. Heat exchangers are typically used in refrigeration systems and often take the form of a gas cooler, condenser, or evaporator.

A conventional refrigeration system including a coil and fin type heat exchanger is schematically illustrated in FIG. 1. Also shown in the schematic illustration of FIG. 1 is a compressor 6, evaporator assembly 8 and fan 18. Heat exchanger 10 generally includes fluid conduit 12 having a generally serpentine structure that includes a series of bends 14 interconnecting a series of parallel straight lengths of the conduit. Fluid conduit 12 extends through a plurality of heat exchange elements 16 such as flat, heat transfer fins. Heat exchange elements 16 are substantially perpendicular to the longitudinal axis of folded conduit 12. Fan 18 of the refrigeration system is positioned to generate an airflow in a direction indicated by arrows 17 that, in turn, induces airflow through the airflow passages defined by adjacent elements 16 as indicated by arrows 19 to thereby remove heat from the heat exchanger.

Oftentimes, the heat exchanger forming the condenser of a refrigeration system will be mounted along the edge of a rectilinear baseplate with a fan mounted thereto and generating an air flow perpendicular to the parallel straight lengths of the conduit and parallel to the airflow passages defined by fins mounted on the straight lengths of the conduits at a perpendicular angle. In the system shown in FIG. 1, heat exchanger 10 is mounted at an angle relative to the edges of the base plate and fan 18 generates an airflow in direction 17 that is at an angle to the direction defined by the airflow passages formed between adjacent heat exchange elements 16 that are mounted on the heat exchanger conduit at a perpendicular angle. In the system illustrated in FIG. 1, the orientation of heat exchanger 10 and the air flow passages extending therethrough relative to the direction of the airflow 17 generated by fan 18 has a negative impact on the quantity of air passing through heat exchanger 10 and, consequently, the ability of the air to remove heat from the heat exchanger.

SUMMARY OF THE INVENTION

The present invention provides a heat exchanger for use in a refrigeration system including a fluid conduit having a plurality of heat transfer elements mounted thereon at a non-perpendicular angle to the longitudinal axis of the conduit. An airblower or fan may also be included in the system and the alignment of the positioning of heat exchange elements is coordinated with the airflow generated by the airblower to enhance the quantity of air passing through the heat exchanger and thereby improving the performance of the heat exchanger.

The invention comprises, in one form thereof, a heat exchanger assembly including a compressor, a heat exchanger and an airblower. The heat exchanger has a fluid conveying conduit in fluid communication with the compressor and a plurality of heat exchange elements thermally coupled with a first heat exchanging segment of the conduit, each of the elements having at least one heat transfer surface. The airblower is mounted in a first position relative to the heat exchanger wherein the airblower generates an airflow in a first direction. The first heat exchanging segment of the conduit substantially extends longitudinally in a second direction with the first direction defining a non-perpendicular first angle with the second direction. The heat transfer surfaces define at least one airflow passage extending through the heat exchanger in a third direction, the third direction defining a non-perpendicular second angle with the second direction, the second angle and the first angle having a difference of no greater than approximately 30 degrees.

The heat exchanger assembly may be configured wherein the first direction defined by the airflow generated by the airblower and the third direction defined by the airflow passage through the heat exchanger are substantially parallel. The first heat exchanging segment of the conduit may have a generally serpentine shape and include a plurality of bends interconnecting a plurality of substantially parallel lengths of the conduit with the lengths extending in the second direction and being vertically spaced and thermally coupled to the heat exchange elements.

The conduit may also include a second heat exchanging segment having a second generally serpentine shape and including a second plurality of bends interconnecting a second plurality of substantially parallel lengths of the conduit extending in a fourth direction. The second lengths are vertically spaced and thermally coupled to a second plurality of heat exchange elements thermally coupled with the second lengths. Each of the second plurality of heat exchange elements have at least one second heat transfer surface wherein the second heat transfer surfaces define at least one second airflow passage extending through the second heat exchanger segment in a fifth direction and the fourth and fifth directions form a non-perpendicular third angle. In an assembly including two heat exchanging segments, the second and fourth directions respectively defined by the first and second heat exchanging segments of the conduit may define an angle and the third and fifth directions defined by the airflow passages extending through the first and second heat exchanging segments may each be substantially parallel to the first direction defined by the airflow generated by the airblower.

The plurality of heat exchange elements may be formed by a plurality of substantially planar fins wherein each of the fins defines first and second heat transfer surfaces disposed on opposite sides of the fin and wherein the fins are disposed substantially parallel to one another.

The invention comprises, in another form thereof, a system having a base plate, compressor, heat exchanger and airblower. The compressor is mounted to the base plate and has a discharge port for discharging compressed fluid. A fluid conveying conduit is in fluid communication with the discharge port of the compressor. The heat exchanger is mounted to the base plate and has a plurality of heat exchange elements thermally coupled with a first heat exchanging segment of the conduit, each of the elements having at least one heat transfer surface. The airblower is mounted to the base plate wherein the airblower generates an airflow in a first direction. The first heat exchanging segment of the conduit substantially extends longitudinally in a second direction with the first direction defining a non-perpendicular first angle with the second direction. The heat transfer surfaces define at least one airflow passage extending through the heat exchanger in a third direction with the third direction defining a non-perpendicular second angle with the second direction, the second angle and the first angle having a difference of no greater than approximately 30 degrees.

The first heat exchanging segment of the system may form a condenser and the fluid compressed by the compressor and discharged into the conduit may be a combustible refrigerant. The base plate may have outer perimetrical edges defining a substantially rectilinear shape wherein the second direction defined by the first heat exchanging segment defines a non-perpendicular angle with the edges and the first heat exchanging segment is positioned proximate the compressor so that airflow generated by the airblower impinges upon both the first heat exchanging segment and the compressor.

Alternatively, the base plate may have a plurality of outer perimetrical edges wherein first and second heat exchanging segments are positioned proximate at least one of the edges and the first and second heat exchanging segments respectively have first and second lengths that cumulatively define a length greater than a length of the at least one proximate edge.

The invention comprises, in another form thereof, a method of transferring thermal energy including circulating a fluid through a circuit having a compressor operably coupled thereto wherein circulation of the fluid includes conveying the fluid through a conduit having a heat exchanging segment; mounting a plurality of heat exchange elements on the heat exchanging segment of the conduit, each of the heat exchange elements having a heat transfer surface, wherein the mounted heat exchange elements are thermally coupled with the conduit and the heat transfer surfaces define at least one airflow passage, the airflow passage extending in a direction that forms a non-perpendicular angle with the heat exchanging segment of the conduit; and generating an airflow at a non-perpendicular angle to the heat exchanging segment of the conduit and wherein the airflow passes through the at least one airflow passage and exchanges thermal energy with the heat transfer surface.

The airflow generated in such a method may be in a direction that is substantially parallel to said at least one airflow passage. The airflow generated in such a method may also impinge upon a compressor operably coupled to the circuit.

One advantage of the present invention is that by aligning an airflow passage extending through a heat exchanger and defined by heat transfer surfaces at a non-perpendicular angle relative to the longitudinal direction of the heat exchanging segment of a fluid conduit, the present invention provides for a higher density and more compact refrigeration or condenser configuration wherein the heat exchanger is positioned in closer proximity to the other components and configured to take advantage of the available space between the other components.

This repositioning of the heat exchanger may require that the airflow generated by the blower intersect the longitudinal direction of the heat exchanging segment of the conduit at a non-perpendicular angle. By defining an airflow passage through the heat exchanger with the heat transfer surfaces that is also non-perpendicular to the longitudinal direction of the conduit, the airflow passage through the heat exchanger may more closely conform to the direction of the airflow generated by the blower and thereby relatively enhance the performance of the heat exchanger in a compact system configuration.

Another advantage of the present invention is that by facilitating the design of relatively compact condenser and refrigeration systems, the lengths of the fluid conduits interconnecting the various components of the system may be reduced thereby reducing the internal volume of the system and facilitating the reduction of the total refrigerant charge required by the system. Such a reduction of the refrigerant charge is particularly advantageous when using combustible refrigerants such as those containing hydrocarbons or ammonia.

Yet another advantage of the present invention is that it provides greater flexibility in the placement of the heat exchanger relative to the other components of the refrigeration system while minimizing or preventing negative impacts on the performance of the heat exchanger that may be associated with the alternative placement of the heat exchanger. The greater flexibility in placement of the heat exchanger also provides benefits such as greater flexibility in cabinet design. Additionally, the heat exchanger may be positioned in proximity to a compressor wherein the airflow generated by the blower impinges upon the compressor as well as the heat exchanger thereby providing enhanced cooling of the compressor and system performance. Such a configuration may also involve the use of two heat exchanger segments which at least partially surround the compressor.

Still another advantage of some embodiments of the present invention is that it provides for the use of two heat exchanging segments positioned proximate an edge of the base plate on which the system is mounted and at an angle to the proximate edge whereby the cumulative lengths of the two heat exchanging segments is greater than the length of the proximate edge. If such segments were replaced by a conventional heat exchanger extending parallel to the proximate edge, to have the same length of conduit within a heat exchanger of the same height would require the heat exchanger to have a greater depth to provide additional rows of conduits. When an excessive number of such heat exchanger conduit rows are added, the performance of the heat exchanger may be degraded because the air passing across the last rows of conduits will have a reduced temperature differential with such conduits due to the thermal energy already transferred to the air by the initial rows of the heat exchanger. By providing for the angled positioning of two heat exchanger segments, the present invention facilitates the avoidance of such inefficient heat exchanger designs.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
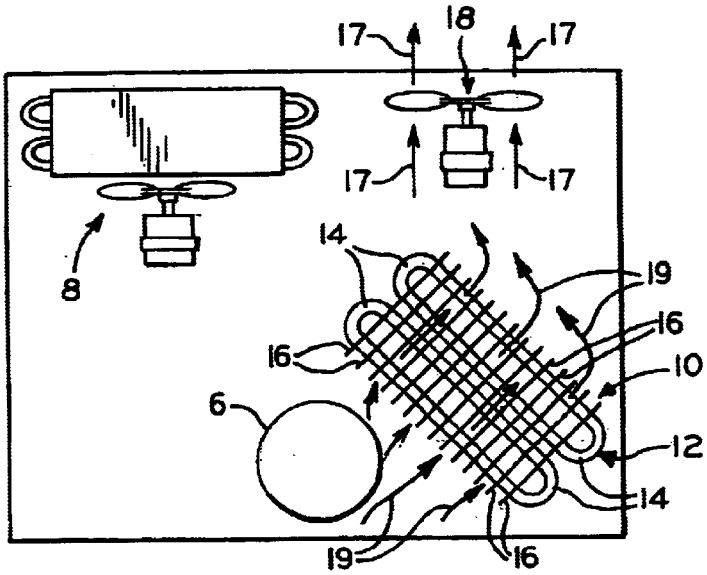
FIG. 1 PRIOR ART
FIG. 1 is a schematic view of a prior art refrigeration system.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

Figure 2:
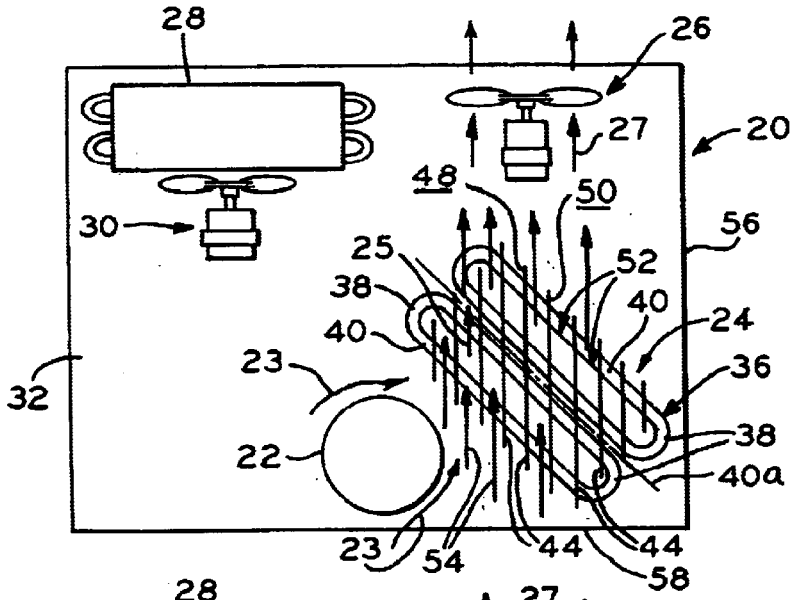
FIG. 2 is a schematic view of a refrigeration system in accordance with the present invention.

Referring now to FIG. 2, refrigeration system 20 is shown having a plurality of components including compressor 22, heat exchanger 24, airblower or fan 26, evaporator 28, and evaporator fan 30. The components of the refrigeration system are mounted to substantially rectangular base plate 32 constructed from any suitable material such as stamped sheet metal. As used herein, mounting a component to the base plate refers to both directly securing the component to the base plate and indirectly securing the components to the base plate through intermediate parts. Compressor 22 may be any suitable type of compressor including a scroll, reciprocating piston, or rotary type compressor. In the illustrated embodiment, heat exchanger 24 is a tube and fin type heat exchanger as discussed in greater detail below. Alternative types of heat exchangers, such as a microchannel type heat exchanger having heat exchange elements defining an airflow path therethrough, however, could also be employed with the present invention.

The components are fluidly connected by several fluid conduits (FIG. 5) through which any suitable type of refrigerant fluid including carbon dioxide, conventional refrigerants, such as R-11, R-12, R-22, combustible refrigerants, such as those containing hydrocarbons or ammonia, and other suitable refrigerants to form a refrigeration system. Refrigerant fluid enters compressor 22 at a low pressure. The low pressure refrigerant is compressed in compressor 22 to a higher discharge pressure. The relatively high temperature and pressure refrigerant gas discharged from compressor 22 flows through heat exchanger 24 where the temperature of the refrigerant is reduced and the refrigerant gas condensed to a liquid. The liquid refrigerant flows through expansion device 34, schematically illustrated in FIG. 5, where the refrigerant pressure is reduced. The low pressure, liquid refrigerant enters evaporator 28 thermal energy transferred from the air directed through evaporator 28 by fan 30 converts the liquid refrigerant into a gas. The air cooled by evaporator 28 is then used to cool a refrigerated cabinet or for some other purpose. The low pressure refrigerant gas then enters compressor 22 to repeat the refrigeration cycle.

The mounting configuration used when securing the refrigeration components to base plate 32 can make the refrigeration system more compact, reducing the amount of space required by the system in a refrigeration machine, for example. In the present embodiment, heat exchanger 24 is positioned within the space available between the other system components to provide a compact design and minimize the length of connecting conduits. Heat exchanger 24 is mounted to base plate 32 in a position which is angled relative to edge 58 of base plate 32, wherein an acute angle exists between edge 58 and the longitudinal direction of heat exchanger 24. Fan 26 is mounted to base plate 32 and pulls air from the side of heat exchanger 24 nearest base plate edge 58 and through heat exchanger 24. Before entering heat exchanger 24 some of the air flow generated by fan 26 impinges upon and cools compressor 22 as indicated by air flow arrows 23.

Figure 4:
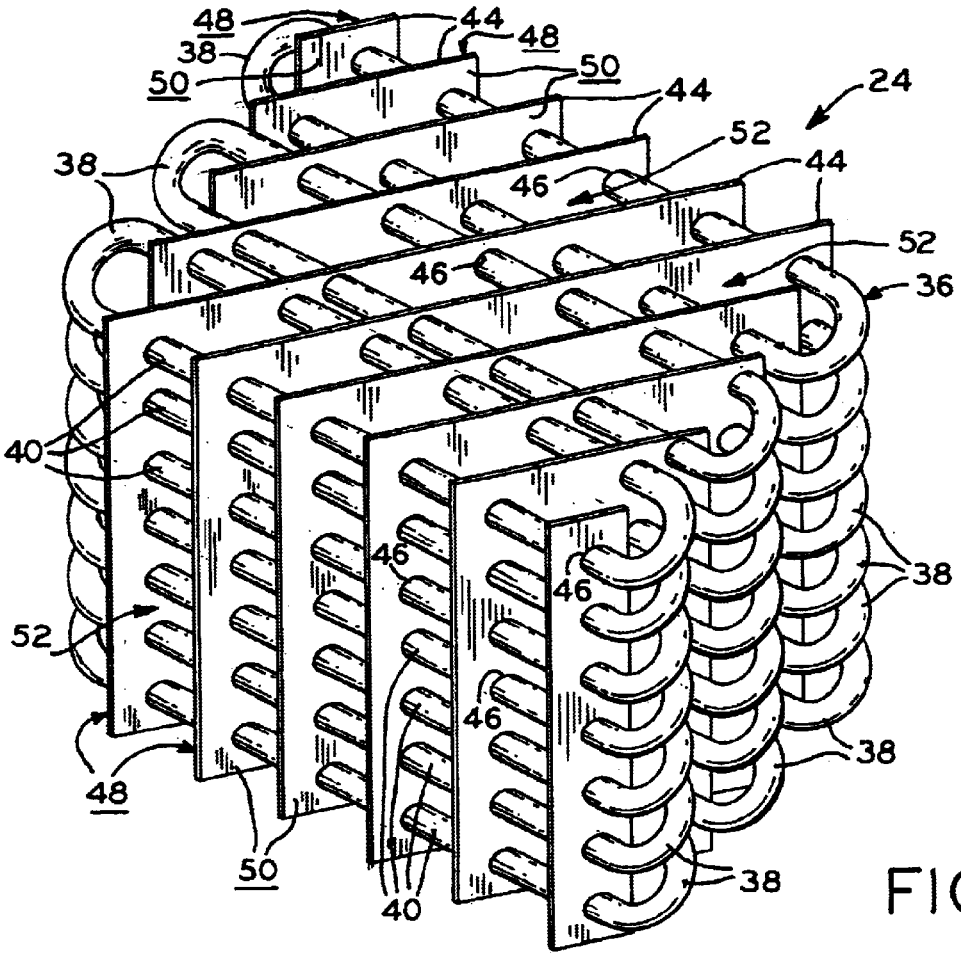
FIG. 4 is a perspective view of a heat exchanger in accordance with the present invention.

Heat exchanger 24 is shown in FIG. 4 and includes a plurality of heat exchange elements 44 mounted on a serpentine-shaped heat exchanging segment of fluid conveying conduit 36 and functions as a condenser. That portion of conduit 36 that forms heat exchanger 24 includes a plurality of straight, parallel, conduit lengths 40 which extend in a longitudinal direction and are interconnected by a plurality of substantially U-shaped fittings or bends 38 to thereby form a single continuous fluid conveying conduit. The figures schematically represent the heat exchangers and do not all depict conduit 36 as defining a single continuous flow path. Alternative embodiments of heat exchangers in accordance with the present invention may include fluid conveying conduits which define branched flow paths.

Heat exchanger 24 may includes any suitable number of lengths 40 and lengths 40 may extend for a suitable distance dependent upon the required heat exchange capacity and the space available for heat exchanger 24. A plurality of heat exchange elements 44, in the form of planar aluminum fins in the illustrated embodiment, are mounted to conduit 36 and thermally coupled therewith. In the assembly of heat exchanger 24, straight conduit lengths 40 are inserted through apertures 46 in parallel positioned heat exchange elements 44. Heat exchange elements 44 have appropriately shaped and positioned apertures 46 to receive straight conduit lengths 40. After inserting conduit lengths 40 through heats exchange elements 44, U-shaped fittings 38 are then sealingly engaged with the ends of lengths 40 by any suitable method including welding, brazing or the like to form a single continuous flow path through heat exchanger 24. Other manufacturing methods known to those having ordinary skill in the art may also be employed to form a heat exchanger in accordance with the present invention. Fluid conduit 36 and heat exchange elements 44 are formed from conventional thermally conductive materials such as copper and aluminum, respectively.

Figure 7:
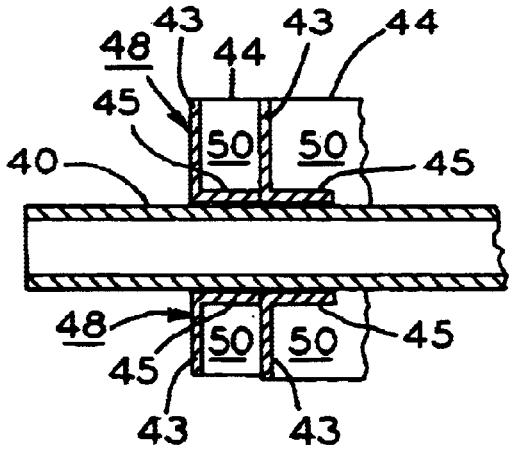
FIG. 7 is a cross sectional view of a portion of a heat exchanger in accordance with the present invention.

Heat exchange elements 44 each have substantially planar heat transfer surfaces 48 and 50 disposed on opposite sides of each element 44. The heat transfer surfaces 48, 50 of adjacently positioned elements 44 define airflow passages 52 therebetween. Heat exchange elements 44 are mounted onto lengths 40 such that heat transfer surfaces 48, 50 define a non-perpendicular angle with the longitudinal axes of lengths 40. A cross sectional view of two heat exchange elements 44 mounted on a conduit length 40 is shown in FIG. 7. In the embodiment illustrated in FIG. 7, each of the elements 44 include a fin portion 43 which extends radially outwardly from conduit length 44 and has two opposed major planar surfaces defining heat transfer surfaces 48, 50. Heat exchange elements 44 also include a flange 45 which defines opening 46 for receiving conduit length 40 and thereby mounting heat exchange elements 44 on conduit length 40. Flanges 45 also facilitate the proper spacing of elements 44 on conduit length 40 and the thermal coupling of elements 44 to conduit length 40. In operation, thermal energy is transferred from refrigerant flowing within conduit 40, through the walls of conduit length 40 to heat exchange elements 44 and then to the air flowing through the heat exchanger by heat transfer surfaces 48, 50.

Figure 3:
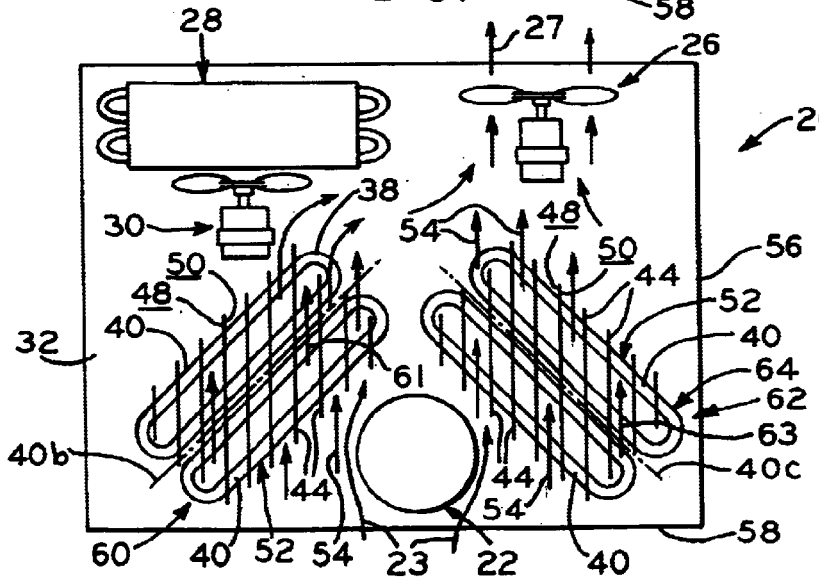
FIG. 3 is a schematic view of a refrigeration system in accordance with an alternative embodiment of the present invention.
Figure 5:
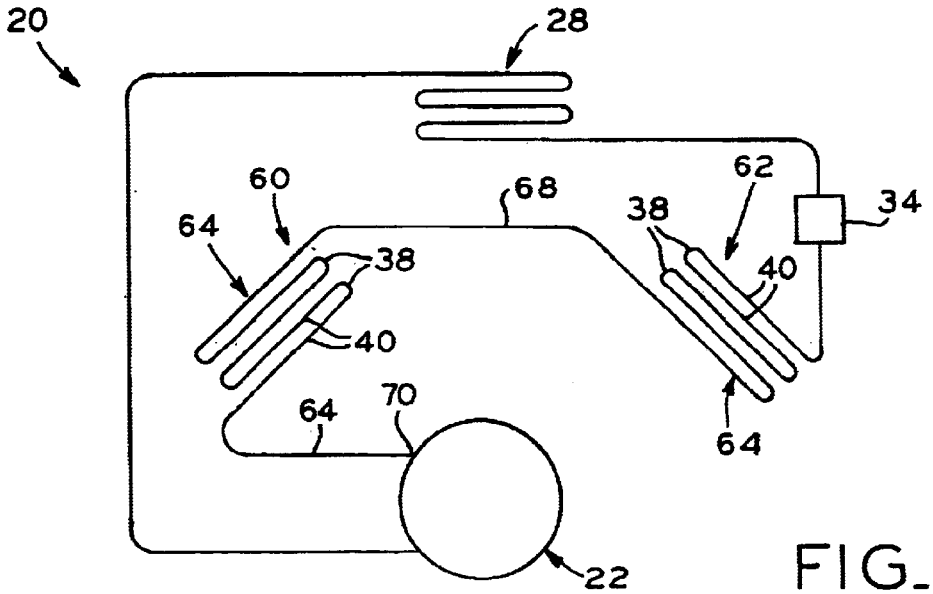
FIG. 5 is a schematic view of the refrigeration system of FIG. 3 illustrating the fluid flow path.

An alternative embodiment of the present invention is schematically illustrated in FIGS. 3 and 5. This embodiment includes a pair of heat exchangers 60 and 62. Each heat exchanger 60 and 62 is formed in the same general manner as described above with regard to heat exchanger 24. Fluid conduit 64 is in fluid communication with the discharge port 70 of compressor 22. Two heat exchangers 60, 62 are positioned in fluid line 64 between compressor 22 and expansion device 34. As shown in FIG. 5, a short length of conduit 68 provides fluid communication between heat exchangers 60, 62 and the fluid line 64 defines a single continuous flow path between compressor 22 and expansion device 34. Refrigeration systems employing alternative flow paths could also be used with alternative embodiments of the present invention. Heat exchangers 60 and 62 are both mounted to base plate 32 at an angle relative to base plate edge 56 with non-perpendicular angle existing between edge 56 and the longitudinal axes of heat exchangers 60, 62. The heat exchangers generally surround compressor 22 and a gap formed between heat exchangers 60, 62 enhances the cooling effect on compressor 22 of the air flow generated fan 26. The use of two angled heat exchangers 60, 62 may allow the heat exchangers to have a longer length and shallower depth than a single heat exchanger extending parallel to a proximate edge of rectilinear base plate 32. For example, the combined total of the longitudinal lengths of heat exchangers 60, 62 could greater than length of proximate edge 58 of base plate 32.

As can be seen in FIG. 3, the air flow through heat exchanger 60 is drawn to fan 26, not evaporator fan 30. The air flow generated by fan 30 through evaporator 28 is separated from the air flow through heat exchangers 60, 62 by an insulated partition (not shown) as is conventional in refrigeration cabinet design. The evaporator illustrated in FIG. 2 is similarly separated from the air flow through heat exchanger 24.

The flow of air during operation of the compressor system employing the present invention, such as in a refrigeration or air conditioning system, is schematically illustrated in FIGS. 2 and 3. As shown, fan 26 generates an air flow that extends in a direction indicated by arrows 27, the airflow passages defined by heat exchangers 24, 60 and 62 extend in directions that are indicated by arrows 25, 61 and 63 respectively and the conduit lengths 40 of heat exchangers 24, 60 and 62 extend in directions 40*a*, 40*b*, and 40*c* respectively.

The longitudinal axes 40*a*, 40*b*, 40*c* of heat exchangers 24, 60, 62 defined by conduit lengths 40 extend at a non-perpendicular angle to the general direction 27 of air flow generated by fan 26. The air flow passage directions 25, 61, 63 defined between the heat exchange elements of heat exchangers 24, 60, 62 also form a non-perpendicular angle with longitudinal axes 40*a*, 40*b*, 40*c* and are coordinated with the air flow direction 27 to enhance the passage of air through heat exchangers 24, 60, 62.

With reference to the embodiment illustrated in FIG. 2 airflow passages 52 extend through heat exchanger 24 in a direction 25 that is substantially parallel to the airflow direction 27 generated by fan 26. Arrows 54 indicate the flow of air through the heat exchangers. The airflow generated by fan 26 also impinges upon compressor 22 to remove thermal energy therefrom as described above. The warmed air is forced by fan 26 out of the confines of refrigeration system 20 to the ambient air. Similarly, in the embodiment illustrated in FIG. 3, although longitudinal axes 40*b*and 40*c* are positioned at an angle to each other, the air flow directions 61, 63 defined by the heat exchange elements of heat exchangers 60, 62 are both substantially parallel to the direction 27 of the air flow generated by fan 26.

Figure 6:
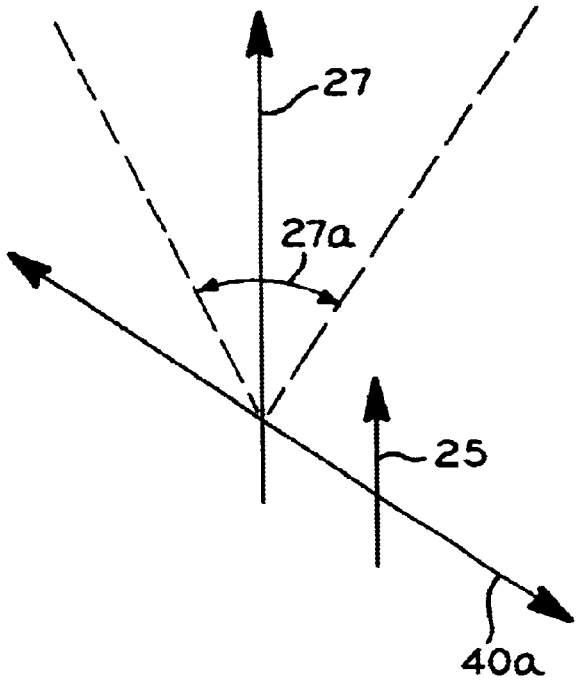
FIG. 6 is a schematic view showing the relationship between the airflow generated by the blower and the heat exchanger conduits and airflow passages.

FIG. 6 schematically illustrates the relationship between the orientation of conduit lengths 40 of heat exchanger 24, the air flow direction 27 generated by fan 26 and the direction 25 defined by air flow passages 52 of heat exchanger 24. As shown, in the illustrated embodiment directions 27 and 25 are substantially parallel and each form a substantially equivalent angle with longitudinal direction 40*a*. The present invention, however, may also utilize heat exchange elements which define air flow passages that form a non-perpendicular angle to conduit lengths 40 that fall within approximately 30 degrees of the angle formed by the direction 27 of the air flow generated by a blower associated with the heat exchanger. The angle marked 27*a* in FIG. 5 represents such a range of angles that extends approximately 30 degrees on each side of air flow direction 27. In some circumstances in may be advantageous to define an air flow passage through the heat exchanger which is not strictly parallel with the air flow direction 27. For example, the angle of the air passages through the heat exchanger may be varied from a parallel orientation to account for the position of another system component adjacent to the heat exchanger or to facilitate the more efficient manufacture of the heat exchanger.

While this invention has been described as having an exemplary design, the present invention may be further modified within the spirit and scope of this disclosure. This application is therefore intended to cover any variations, uses, or adaptations of the invention using its general principles.

What is claimed is:

1. A heat exchanger assembly comprising:

a compressor;

a heat exchanger having a fluid conveying conduit in fluid communication with said compressor and a plurality of substantially planar fins thermally coupled with a first heat exchanging segment of said conduit, each of said fins defining first and second heat transfer surfaces disposed on opposite sides of said fin and wherein said fins are disposed substantially parallel to one another;

an airblower mounted in a first position relative to said heat exchanger wherein said airblower generates an airflow in a first direction, said first heat exchanging segment of said conduit substantially extending longitudinally in a second direction, said first direction defining a non-perpendicular first angle with said second direction; and wherein said heat transfer surfaces define at least one airflow passage extending through said heat exchanger in a third direction, said third direction defining a non-perpendicular second angle with said second direction, said second angle and said first angle having a difference of no greater than approximately 30 degrees.

2. The heat exchanger assembly of claim 1 wherein said first direction and said third direction are substantially parallel.

3. The heat exchanger assembly of claim 1 wherein said first heat exchanging segment of said conduit has a generally serpentine shape and includes a plurality of bends interconnecting a plurality of substantially parallel lengths of said conduit, said lengths extending in said second direction and being vertically spaced and thermally coupled to said substantially planar fins.

4. A heat exchanger assembly comprising:

a compressor;

a heat exchanger having a fluid conveying conduit in fluid communication with said compressor and a plurality of heat exchange elements thermally coupled with a first heat exchanging segment of said conduit, each of said elements having at least one heat transfer surface; and an airblower mounted in a first position relative to said heat exchanger wherein said airblower generates an airflow in a first direction, said first heat exchanging segment of said conduit substantially extending longitudinally in a second direction, said first direction defining a non-perpendicular first angle with said second direction, wherein said heat transfer surfaces define at least one airflow passage extending through said heat exchanger in a third direction, said third direction defining a non-perpendicular second angle with said second direction, said second angle and said first angle having a difference of no greater than approximately 30 degrees, and wherein said first direction and said third direction are substantially parallel, and wherein said conduit further includes a second heat exchanging segment having a second generally serpentine shape and including a second plurality of bends interconnecting a second plurality of substantially parallel lengths of said conduit extending in a fourth direction, said second lengths being vertically spaced and thermally coupled to a second plurality of heat exchange elements thermally coupled with said second lengths, each of said second plurality of heat exchange elements having at least one second heat transfer surface wherein said second heat transfer surfaces define at least one second airflow passage extending through said second heat exchanger segment in a fifth direction, said fourth and fifth directions forming a non-perpendicular third angle.

5. The heat exchanger assembly of claim 4 wherein said second and fourth directions define an angle and said third and fifth directions are each substantially parallel to said first direction.

6. A system comprising:

a base plate;

a compressor mounted to said base plate and having a discharge port for discharging compressed fluid;

a fluid conveying conduit in fluid communication with said discharge port of said compressor;

a heat exchanger mounted to said base plate and having a plurality of heat exchange elements thermally coupled with a first heat exchanging segment of said conduit, each of said elements having at least one heat transfer surface;

an airblower mounted to said base plate wherein said airblower generates an airflow in a first direction, said first heat exchanging segment of said conduit substantially extending longitudinally in a second direction, said first direction defining a non-perpendicular first angle with said second direction; and wherein said heat transfer surfaces define at least one airflow passage extending through said heat exchanger in a third direction, said third direction defining a non-perpendicular second angle with said second direction, said second angle and said first angle having a difference of no greater than approximately 30 degrees.

7. The system of claim 6 wherein said base plate includes outer perimetrical edges defining a substantially rectilinear shape and said second direction defines a non-perpendicular angle with said edges, said first heat exchanging segment being positioned proximate said compressor wherein airflow generated by said airblower impinges upon both said first heat exchanging segment and said compressor.

8. The system of claim 6 wherein said first direction and said third direction are substantially parallel.

9. The system of claim 6 wherein said first heat exchanging segment of said conduit has a generally serpentine shape and includes a plurality of bends interconnecting a plurality of substantially parallel lengths of said conduit, said lengths extending in said second direction and being vertically spaced and thermally coupled to said heat exchange elements.

10. The system of claim 9 wherein said conduit further includes a second heat exchanging segment having a second generally serpentine shape and including a second plurality of bends interconnecting a second plurality of substantially parallel lengths of said conduit extending in a fourth direction, said second lengths being vertically spaced and thermally coupled to a second plurality of heat exchange elements thermally coupled with said second lengths, each of said second plurality of heat exchange elements having at least one second heat transfer surface wherein said second heat transfer surfaces define at least one second airflow passage extending through said second heat exchanger segment in a fifth direction, said fourth and fifth directions forming a non-perpendicular third angle.

11. The system of claim 10 wherein said second and fourth directions define an angle and said third and fifth directions are each substantially parallel to said first direction.

12. The system of claim 10 wherein said base plate includes a plurality of outer perimetrical edges, said first and second heat exchanging segments positioned proximate at least one of said edges, said first heat exchanging segment has a first length and said second heat exchanging segment has a second length, said first and second lengths cumulatively defining a length greater than a length of said at least one proximate edge.

13. The system of claim 6 wherein said plurality of heat exchange elements comprise a plurality of substantially planar fins, each of said fins defining first and second heat transfer surfaces disposed on opposite sides of said fin and wherein said fins are disposed substantially parallel to one another.

14. The system of claim 6 wherein said first heat exchanging segment forms a condenser.

15. The system of claim 6 wherein a combustible refrigerant is compressed by said compressor and discharged into said conduit.

16. A method of transferring thermal energy comprising:

circulating a fluid through a circuit having a compressor operably coupled thereto wherein circulation of the fluid includes conveying the fluid through a conduit having a heat exchanging segment;

mounting a plurality of heat exchange elements on said heat exchanging segment of said conduit, each of said heat exchange elements having a heat transfer surface, wherein said mounted heat exchange elements are thermally coupled with said conduit and said heat transfer surfaces define at least one airflow passage, said airflow passage extending in a direction that forms a non-perpendicular angle with said heat exchanging segment of said conduit; and generating an airflow at a non-perpendicular angle to said heat exchanging segment of said conduit, wherein said airflow passes through said at least one airflow passage and exchanges thermal energy with said heat transfer surface, and wherein said airflow impinges upon said compressor.

17. The method of claim 16 wherein said airflow is generated in a direction that is substantially parallel to said at least one airflow passage.

18. A method of transferring thermal energy comprising:

circulating a fluid through a circuit having a compressor operably coupled thereto wherein circulation of the fluid includes conveying the fluid through a conduit having a heat exchanging segment;

mounting a plurality of heat exchange elements on said heat exchanging segment of said conduit, each of said heat exchange elements having a heat transfer surface, wherein said mounted beat exchange elements are thermally coupled with said conduit and said heat transfer surfaces define at least one airflow passage, said airflow passage extending in a direction that forms a non-perpendicular angle with said heat exchanging segment of said conduit; and generating an airflow at a non-perpendicular angle to said heat exchanging segment of said conduit and wherein said airflow passes through said at least one airflow passage and exchanges thermal energy with said heat transfer surface, wherein the heat exchanging segment of said conduit has a generally serpentine shape and includes a plurality of bends interconnecting a plurality of substantially parallel lengths of said conduit, said lengths being vertically spaced and thermally coupled to said heat exchange elements and wherein said plurality of heat exchange elements comprise a plurality of substantially planar fins, each of said fins defining first and second heat transfer surfaces disposed on opposite sides of said fin, said fins being disposed substantially parallel to one another.

* * * * *

UNITED STATES PATENT AND TRADEMARK OFFICE

CERTIFICATE OF CORRECTION

PATENT NO. : 6,793,010 B1
DATED : September 21, 2004
INVENTOR(S) : Dan M. Manole It is certified that error appears in the above-identified patent and that said Letters Patent is hereby corrected as shown below:

Column 11,
Line 9, delete “beat” and insert -- heat --

Signed and Sealed this

Fifth Day of April, 2005

JON W. DUDAS
*Director of the United States Patent and Trademark Office*